US006271457B1

(12) United States Patent
Hudak

(10) Patent No.: US 6,271,457 B1
(45) Date of Patent: Aug. 7, 2001

(54) PIEZOELECTRIC BRIDGE-TYPE PICKUP FOR A STRINGED MUSICAL INSTRUMENT

(75) Inventor: William Hudak, Hebron, CT (US)

(73) Assignee: Kaman Music Corporation, Bloomfield, CT (US)

( * ) Notice: Subject to any disclaimer, the term of this patent is extended or adjusted under 35 U.S.C. 154(b) by 0 days.

(21) Appl. No.: 09/574,983

(22) Filed: May 19, 2000

(51) Int. Cl.[7] ..... G10H 3/18
(52) U.S. Cl. ..... 84/731; 84/DIG. 24
(58) Field of Search ..... 84/731, DIG. 24

(56) References Cited

U.S. PATENT DOCUMENTS

| | | | |
|---|---|---|---|
| 2,784,631 | | 3/1957 | Fender . |
| 3,073,202 | | 1/1963 | Evans . |
| 3,453,920 | | 7/1969 | Scherer . |
| 3,530,228 | | 9/1970 | Scherer . |
| 3,712,951 | | 1/1973 | Rickard . |
| 4,278,000 | * | 7/1981 | Saito et al. ..... 84/731 |
| 4,314,495 | | 2/1982 | Baggs . |
| 4,378,721 | * | 4/1983 | Kaneko et al. ..... 84/731 |
| 5,052,269 | | 10/1991 | Young, Jr. . |
| 5,206,449 | | 4/1993 | McClish . |
| 5,252,777 | | 10/1993 | Allen . |
| 5,322,969 | * | 6/1994 | Aaroe et al. ..... 84/731 |
| 5,637,823 | | 6/1997 | Dodge . |
| 5,866,835 | | 2/1999 | Baggs . |

* cited by examiner

*Primary Examiner*—Stanley J. Witkowski
(74) *Attorney, Agent, or Firm*—McCormock, Paulding & Huber LLP

(57) ABSTRACT

A bridge type piezoelectric pickup for guitars and other stringed instruments that has a flexible circuit board carrying a pair of transversely polarized piezoelectric crystals for each string, the two crystals of each string being closely spaced from one another along the length of the string and supporting a common saddle resting on both of the crystals and supportingly engaging the associated string.

28 Claims, 5 Drawing Sheets

PIEZOELECTRIC BRIDGE-TYPE PICKUP FOR A STRINGED MUSICAL INSTRUMENT

FIELD OF THE INVENTION

This invention concerns a pickup or electro-mechanical transducer for converting the vibrations of one or more strings of a stringed musical instrument into electrical signals and of the type wherein the pickup has for each string at least one piezoelectric crystal forming part of the instrument bridge and arranged to be excited by the string vibration, and deals more particularly with such a bridge-type piezoelectric pickup having an improved construction and performance in comparison to previously proposed pickups of such type.

BACKGROUND OF THE INVENTION

Although many different constructions of bridge-type piezoelectric pickups have been proposed and used in the past, such pickups have often been subject to one or more troubling deficiencies such as difficult and time-consuming assembly requirements, excessive weight or mass, susceptibility to the introduction of noise or interference into the signal transmission system, excessive cross-talk in signals from nearby strings, and weak output signals resulting in frequency response losses as the signals are transmitted to remote amplifying circuits. A further difficulty often is the inability to easily selectively adapt a given multiple string pickup to have either a single monaural output or a multiple channel output, or to be responsive to different modes of string vibration.

The object of the present invention is, therefore, to provide an improved bridge-type piezoelectric pickup which, among other desirable things, significantly reduces or overcomes the above-mentioned deficiencies of prior pickups.

SUMMARY OF THE INVENTION

The invention resides in a bridge-type piezoelectric pickup for use with a stringed musical instrument, such as a guitar, mandolin, lute, violin or the like, having a body with a top surface and at least one stretched string extending over the top surface and supported at one point by a bridge located between the top surface and the string with the bridge holding the string in a somewhat deflected condition so that the string presses downwardly on the bridge. An individual string-engaging saddle is provided for each string and at its lower end rests on a set of two piezoelectric crystals arranged at different locations along the length of the string so that the two crystals are excited in a common or in-phase way by the movement of the saddle, arising from vibration of the string in a plane perpendicular to the string, and are excited in a non-common or out-of-phase way by movement of the saddle arising from vibration of the string in the longitudinal direction of its length. The use of the pair of crystals and a separate saddle for each string minimizes cross talk between nearby strings. In addition, neighboring pairs of crystals are advantageously connected out of phase with one another to further reduce cross-talk signals from adjacent string excitation.

The invention also resides in the pickup having an active semiconductor circuit, such as an operational amplifier, located in close proximity to and electrically connected with the piezoelectric crystal set of each string to provide a high impedance input for the electrical signal produced by the crystal set, and some amplification may also be provided by the active semiconductor circuit or operational amplifier or by an associated amplification stage forming part of the pickup, so that the output signal can be transmitted efficiently from the pickup to a remotely located supporting circuitry without significant frequency response losses and/or the accumulation of significant amounts of hum or other noise or interference by the transmitted signal.

The invention also resides in the piezoelectric crystals, operational amplifiers and other electronic components of the pickup being carried by a circuit board, by the circuit board advantageously being a flexible one, and by the piezoelectric crystals and other electronic components being attached to the circuit board by surface mount technology techniques so as to facilitate the assembly of the pickup. In keeping with this, the two piezoelectric crystals of each set are advantageously "transversely-polarized" ones with each having two vertically spaced horizontal excitation faces between which the crystal is compressed by forces from the associated string and two horizontally spaced vertical voltage signal terminal faces, so that the two voltage signal terminal faces of each crystal can be directly connected to the upper surface of the circuit board, as by surface mount soldering. Also, the flexible circuit board preferably has an elongated tail portion, with electrical conductors, extending from the body of the pickup, which tail portion can be inserted through a hole in the top plate of the instrument for electrical connection to a power supply, preamplifier, and/or other module located within the instrument body.

A further feature of the invention is that the circuit board is thin and its bottom surface is exposed in relation to other parts of the pickup so as to directly engage the top surface of the instrument with which the pickup is used, to provide a beneficial direct and firm transmission of the vibratory forces of a string to the associated set of piezoelectric crystals, and through those crystals to the instrument top.

The pickup of the invention not only reduces cross-talk and frequency response losses and is of a simplified construction, but also when used to provide multiple independent signal channels, that is, one independent signal channel per string, also allows for individual tailoring of signal equalization as well as other individual signal processing, and provides the basis for multi-channel analog to digital conversion and attendant digital signal processing techniques and control functions afforded in the digital domain. For example, one or a selected set of strings can be selected for reproduction, different string signals can be amplified or otherwise modified in different ways, or different string signals can be amplified and sent to different speakers for reproduction.

Other features and advantages of the invention will be apparent from the following detailed description of a preferred embodiment of the invention, and from the accompanying drawings and claims.

DETAILED DESCRIPTION OF THE PREFERRED EMBODIMENTS

Figure 1:
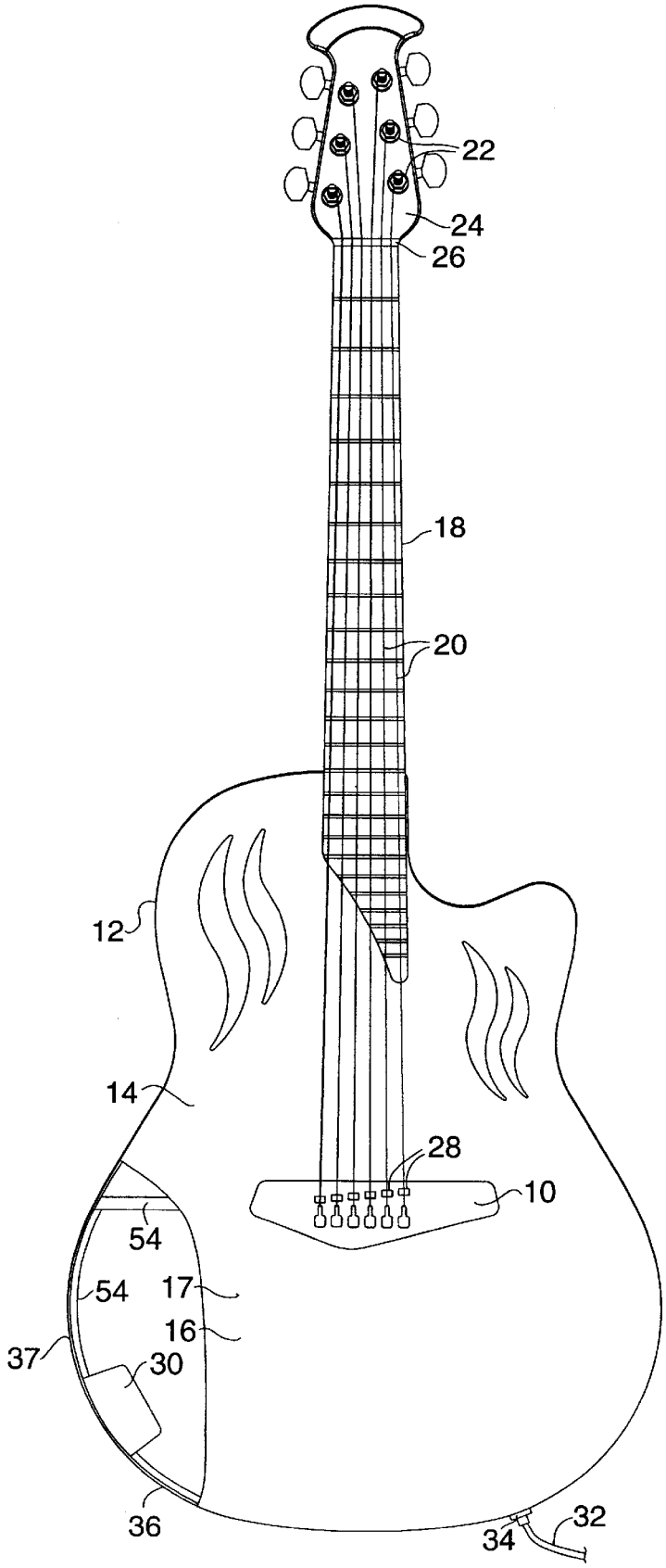
FIG. 1—A plan view of a guitar having a piezoelectric bridge-type pickup embodying the invention, with a portion of the top of the guitar being broken away to reveal further details.

Referring to FIG. 1, a piezoelectric bridge-type pickup 10 embodying the invention is shown in use with a stringed musical instrument in the form of a guitar 12 having a hollow body 14 with a top or soundboard 16 and a neck 18. In the illustrated case, the bridge-type pickup (bridge) 10 also serves as an anchor or tail piece for the strings 20 of the guitar with the strings being stretched between the bridge 10 and machine heads 22 carried by a peghead 24 at the upper end of the neck 18, and with the strings passing over a nut 26 at the upper end of the neck and individual saddles 28 forming part of the bridge 10. The strings, as customary, are held in slightly bent conditions by the nut 26 and the saddles 28, so that the stretched strings press downwardly both on the nut 26 and onto the saddles 28.

As explained in more detail later, electrical signals delivered by the bridge 10 and excited by vibrations of the strings 20 may be, and in the illustrated case of FIG. 1 are, transmitted to an electronic module 30 located within the guitar body 14 for amplification, tone control, mixing or other electronic processing, and the signals output from the module are then transmitted to a remote sound system for reproduction, recording and/or possible further modification or processing. The transmission to the remote system may be a wireless one or, as in the illustrated case, may take place through a cable 32 plugged into an outlet jack 34 on the guitar body 14, the output signals of the module 30 being transmitted to the output jack by a suitable means, such as the illustrated flat flexible cable 36 attached to the inner surface of a sidewall portion 37 of the guitar body.

The electronic module 30, or an associated separate holder located in the guitar body 14, may also carry one or more batteries providing power for the active components of the module 30 and bridge 10, with the guitar body including a normally closed opening or some other means providing an access needed for battery replacement. As an alternative to this, in cases where the output signals are transmitted to a remote system by a cable, such as the cable 32, the needed power can be supplied to the guitar through the cable from the remote system.

Figure 2:
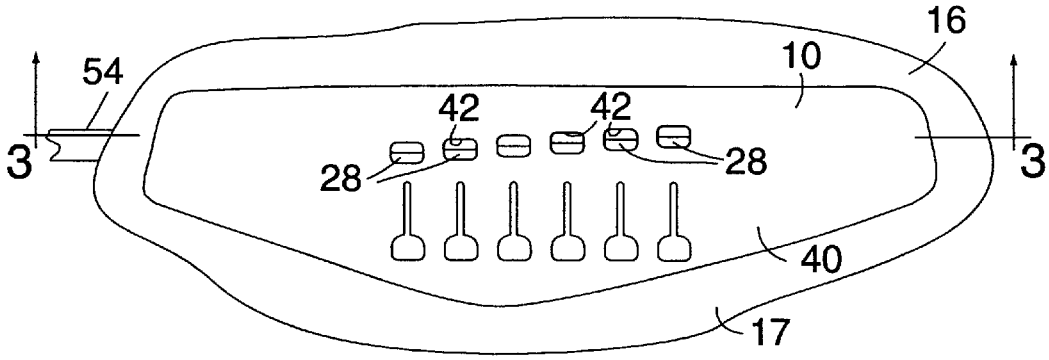
FIG. 2—An enlarged plan view of the piezoelectric bridge-type pickup of FIG. 1 with the strings of the instrument being omitted for clarity.
Figure 3:
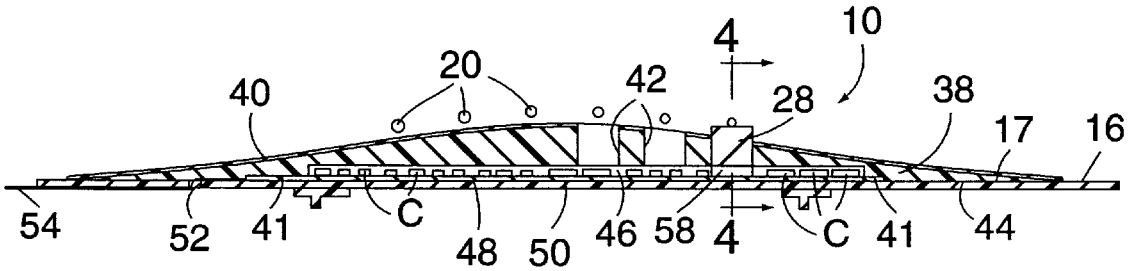
FIG. 3—A sectional view of the piezoelectric bridge-type pickup of FIG. 1 taken on the line 3—3 of FIG. 2 and including a showing of the instrument strings.
Figure 4:
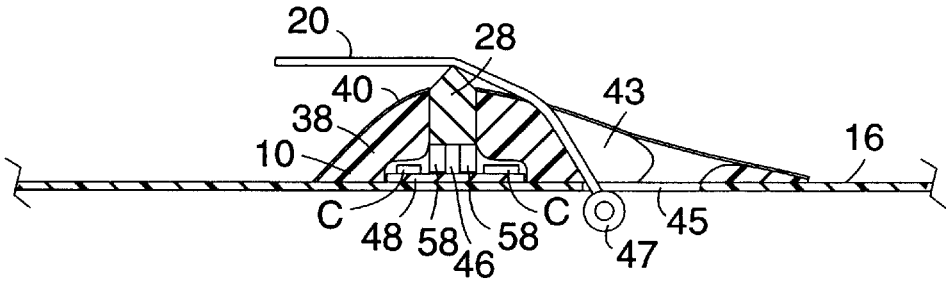
FIG. 4—An enlarged sectional view taken on the line 4—4 of FIG. 3.
Figure 5:
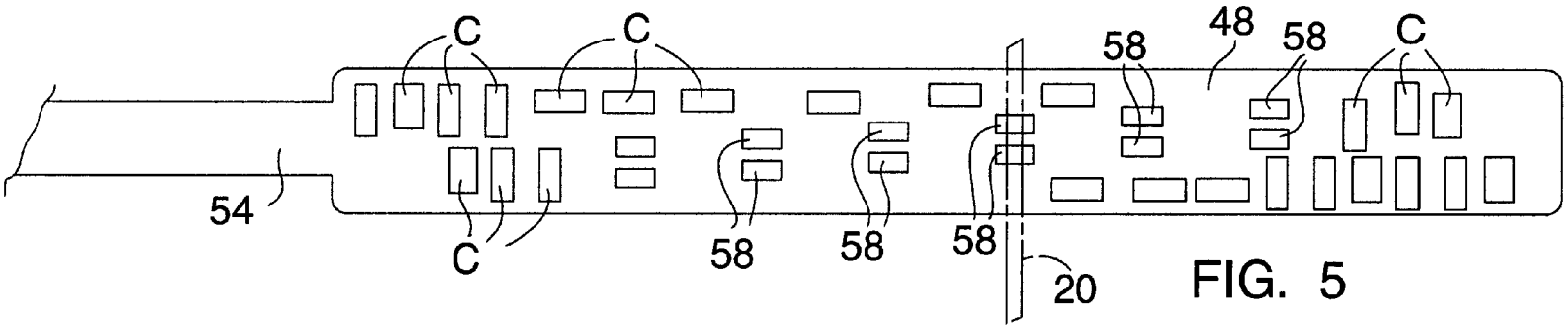
FIG. 5—A plan view of the circuit board used in the piezoelectric bridgetype pickup of FIG. 1.

Turning to FIGS. 2–7 for a more detailed description of the bridge 10, the bridge has a body 38 preferably made of a molded composite material such as one comprised of graphite fibers embedded in an epoxy resin matrix, and the body 38 is covered by a thin walled decorative plastic cap 40, the cap 40 being preferably made of a molded layer of graphite fiber fabric embedded in an epoxy resin matrix. As seen in FIGS. 1 and 2, the body 38 and cap 40 have six openings 42, one for each string, extending through the body and cap from front to rear with each opening 42 slidably receiving a respective one of the saddles 28. The bridge body has a rear face 44 flatly engaging and bonded to the outer or top surface 17 of the soundboard 16. The saddle 28 can be made of any suitable hard relatively non-vibration dampening material such as metal, plastic, wood, graphite/epoxy composite, or bone. As shown in FIGS. 2 and 4, the bridge body 38 and cap 40 also have six through slots 43, each of which registers with a hole 45 in the top 16, to receive the associated string 20 and to anchor the string to the guitar 10 in the manner shown in FIG. 4, each string 20 having a customary ball or bead 47 at its bridge end for this anchoring purpose.

Communicating with the rear face of 44 of the bridge body 38, the body has a recess 46 extending forwardly and laterally across all six of the openings 42 and also extending some distance laterally outwardly beyond each of the two end openings 42. In the back or rear portion of the recess 46 is a circuit board 48 having an exposed rear surface 50 which directly engages the top surface of the top 16. The circuit board 48 is preferably made of a thin flexible material and includes a multiple conductor carrying ribbon-like tail portion 54 which extends through an opening 52 in the top 16 to the electronic module 30 inside the guitar body, the tail portion being secured by adhesive to the rear surface of the top 16 and the inner surface of the body side wall portion as shown in FIGS. 1, 2 and 3.

In the embodiment of FIGS. 3 and 4, the circuit board 58 can be a member which is separate from and unattached to the bridge body 38 and which becomes attached to the guitar and to the bridge body 38 only upon the bridge body 38 being adhesively secured or otherwise bondingly to the guitar top 16 with the circuit board 48 being captured between the bridge body 38 and the top 16. As an alternative to this, to keep the circuit board assembled with the bridge body 38 prior to attachment of the bridge to the guitar, the circuit board can be adhesively attached to the bridge body 38 at its ends, as indicated at 41 in FIG. 3. In either case, the major portion of the circuit board 48 located in the recess 46 is in direct engagement with the top 16, is held against the top 16 by the downward pressure of the saddles 28, and is free to vibrate with the top 16 independently of the bridge body 38.

The circuit board 38 carries at least one, and in the preferred and illustrated case a pair, of piezoelectric crystals 58 for each of the strings 20. It also carries a number of electrical circuit components indicated in a suggestive way at C in FIGS. 3, 4 and 5, these components C being the capacitors, resistors and operational amplifier modules of FIG. 9. Preferably, the piezoelectric crystals 58 and the other components C carried by the circuit board 48 are ones which are adapted for surface mounting to the surface of the circuit board 48 and are so mounted to the circuit board by suitable and well-known surface mounting techniques such as wave soldering or infrared heating.

Figure 6:
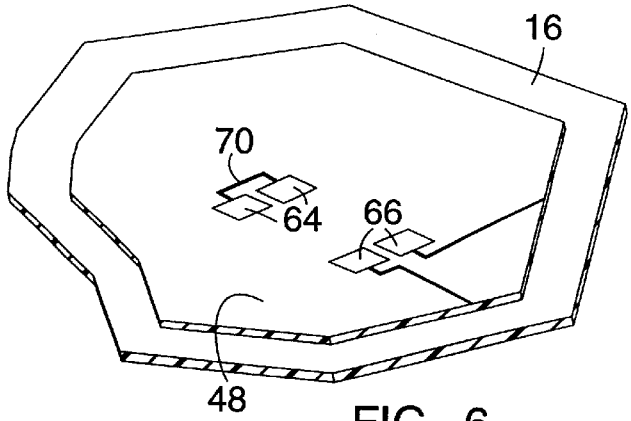
FIG. 6—A fragmentary perspective view of a portion of the circuit board of the piezoelectric bridge-type pickup of FIG. 1 and showing the soldering pads for receiving the two piezoelectric crystals associated with one of the strings of the instrument.
Figure 7:
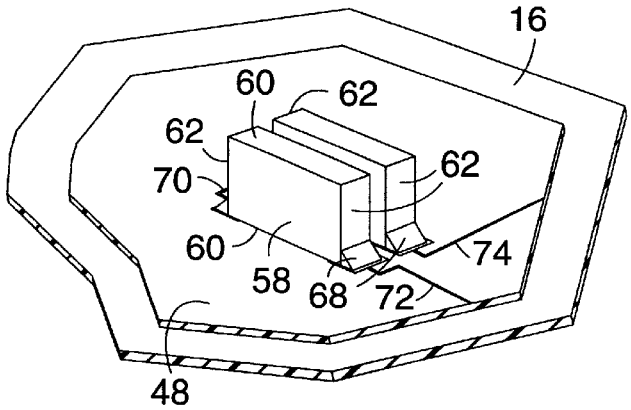
FIG. 7—A view similar to FIG. 6 but showing the two piezoelectric crystals attached to the soldering pads of FIG. 6.

Referring to FIGS. 4–8, the two piezoelectric crystals 58 associated with each string are transversely polarized ones so, as indicated in FIG. 7, each crystal has two vertically spaced horizontal top and bottom faces 60 between which the crystal is pressed by the downward force exerted on it by the associated saddle 28 and also has two laterally spaced vertical signal faces 62 across which appears a voltage signal having an intensity related to the degree to which the crystal is compressed by the saddle 28 against the top 16. As shown in FIG. 6, prior to the attachment of the piezoelectric crystals 58 to the circuit board, the circuit board has two soldering terminal pads 64 and 66 for each of the two crystals 58. The crystals are then attached to the circuit board as shown in FIG. 7 by small amounts of solder 68 connecting each one of the vertical faces 62 to an associated one of the soldering pads 64 or 66. The two soldering pads 64 are connected to one another by a conductor path 70 on the circuit board and the two soldering pads 66 are connected to conductor paths or lines 72 and 74. Therefore, after the crystals 58 are connected to the soldering pads 64 and 66, as shown in FIG. 7, they become connected in series with one another between the lines 72 and 74.

Figure 8:
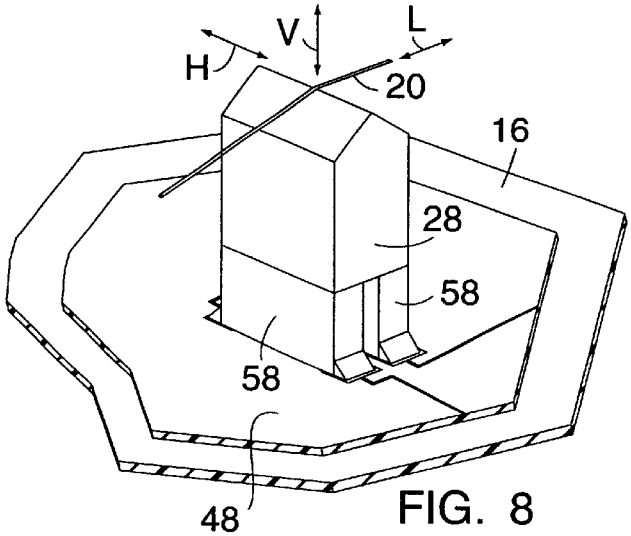
FIG. 8—A view similar to FIG. 7 but showing the associated saddle positioned on the two piezoelectric crystals and supporting the associated string.

As shown in FIG. 8, the saddle 28 of each string 20 rests equally on its two associated piezoelectric crystals 58 with the crystals being spaced from one another in the longitudinal direction of the string 20. When the string 20 is vibrated as a result of being plucked by a player, the string vibrates in all directions in a plane perpendicular to the string and also vibrates in the direction longitudinally of the string. The vibrations occurring in the plane perpendicular to the string are referred to as "in-plane" vibrations and the vibrations occurring along the length of the string are referred to as "longitudinal vibrations". The in-plane vibrations can be resolved into vertical and horizontal components occurring in the directions of the arrows V and H of FIG. 8, and the longitudinal vibrations occur in the direction of the arrow L of FIG. 8.

From a study of FIG. 8, it will be apparent that the vibrations occurring in the direction of the arrows V and H and transmitted to the two crystals 58 by the saddle 28 will have the same or common effect on each of the two crystals 58. That is, the voltage signal appearing across the two faces 62, 62 of one crystal will be substantially the same as that appearing across the faces 62, 62 of the other crystal. On the other hand, the longitudinal string vibration occurring in the direction L will have a non-common effect on the two associated crystals 58, 58. That is, the longitudinal vibration tends to rock the top of the saddle 28 in the longitudinal direction of the string, and when this occurs, the pressure applied by the saddle 22 to one of the crystals increases while the pressure applied to the other crystal decreases, so that the signals appearing across the two faces 62 of one crystal will be essentially 180° out of phase with the signals appearing across the faces 62 of the other crystal.

Figure 9:
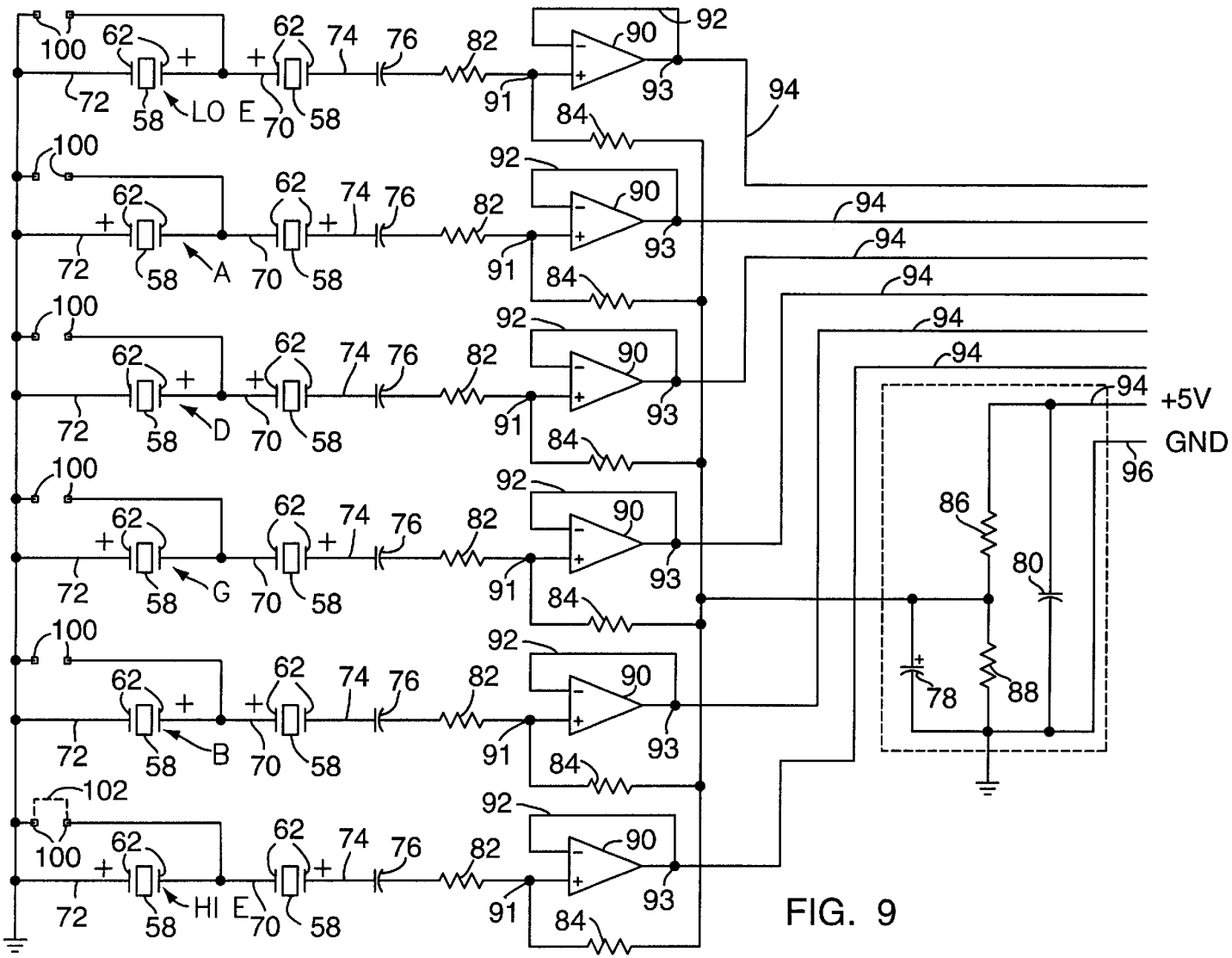
FIG. 9—A circuit diagram showing schematically the elements received on the circuit board of the piezoelectric bridge-type pickup of FIG. 1 and their electrical interconnections.

The circuit diagram of FIG. 9 shows the electrical interconnection of the piezoelectric crystals 58 and components C carried by the circuit board 48. In addition to the piezoelectric crystals 58, the circuit of FIG. 9 includes capacitors 76, 78, 80, resistors 82, 84, 86, 88, and operational amplifier modules 90 which constitute the components C of FIGS. 3, 4 and 5, it being understood that the particular arrangement of the components C on the circuit board 48 may vary considerably depending on the shapes and packaging of the various components used. Further, in the circuit of FIG. 9, the components on the circuit board are arranged into a power supply sub-circuit 92 and six substantially identical signal circuits, the six signal circuits being designated respectively LO E, A, D, G, B and HI E. Each signal channel is associated with a respective one of the strings 20 of the instrument, and the designation given to the channel in FIG. 9 corresponds to the musical tone to which the associated string is customarily tuned.

Referring to FIG. 9, the power supply circuit 92 is connected to a +5V line 94 and a ground line 96 both originating from the module 30 contained in the guitar body and reaching the circuit board through the flexible circuit board tail portion 54. The two capacitors 78 and 80 filter out undesired noise, and the two resistors 86 and 88 provide a voltage signal on the line 98 of suitable positive voltage level for use with the active operational amplifiers 90.

In each of the signal channels, the two crystals 58 of the channel are connected in voltage bucking relationship to one another. That is, the two output faces 62 connected by the conductor 70 are of the same polarity, the positive polarity face 62 of each crystal 58 being indicated by a +. Therefore, when the two crystals of each channel are excited in a common way, as by vibrations occurring in the direction of the arrow V of FIG. 8 and vibrations occurring in the direction of the arrow H of FIG. 8, the signals produced by the two crystals 58 essentially cancel one another to create little or no signal on the output line 74. However, when the two crystals of a channel are excited in a non-common and 180° out of phase way as by longitudinal string vibrations occurring in the direction of the arrow L of FIG. 8, the signals produced by the two crystals 58 of each channel aid one another and create a significant output signal on the line 74.

The signal appearing on the piezoelectric output line 74 of each channel is coupled to an associated active electronic circuit, preferably of semiconductor conduction and in the form of an operational amplifier 90, located close to the associated peizoelectric crystals 58, and with an input terminal 91 and an output terminal 93, through the associated capacitor 76 and resistor 82, and the operational amplifier is preferably conditioned by the associated resistor 84 and feedback line 92 to operate essentially as an emitter-follower so as to have a very high input impedance and a low output impedance as seen by the output line 94 on which the output signal from the operational amplifier 90 appears. The six output lines 94 convey the output signals of the six signal channels to the module 30 in the body of the guitar through the tail portion 54 of the flexible circuit board, and as mentioned, the module 30 may then further amplify or otherwise process the signals before transmission from the guitar to a remote signal utilizing system.

Instead of functioning solely as emitter-followers, the operational amplifiers 90 of FIG. 9 may be conditioned to also provide a small degree of signal amplification so that the signals appearing on the output lines 94 are amplified versions of the signals appearing on the piezoelectric output lines 74. As an alternative to this, each signal channel of the circuit shown in FIG. 9 can also be designed to include a second active electronic circuit, such as a second operational amplifier following the first operational amplifier 90, to provide relatively large amplification of the output signal from the operational amplifier 90 before its transmission to the output line 94.

As shown in FIG. 9, each signal channel includes two terminal pads 100 on the circuit board 48. These two terminal pads 100 are connected respectively to the two output faces 62 of one of the peizoelectric crystals 58. Therefore, by connecting a conductor, such as shown by broken lines at 102 for the HI E signal channel, one of the piezoelectric crystals of a channel can be short circuited from the channel and so that the other piezoelectric crystal of the channel is then the only one supplying a signal to the output line 74 and to the associated operational amplifier 90. If this is done, the involved channel will then essentially be responsive to the in-plane vibrations of the string and non-responsive to the longitudinal vibrations of the string. The two terminal pads 100 of each signal channel are made to be easily accessible on the circuit board 48 so that before installing the bridge pickup onto a guitar, the installer can easily short the two terminal pads 100 of each channel to one another to change the pickup from one responsive essentially to only longitudinal string vibrations to one responsive essentially to only in-plane string vibrations. Of course, if desired the two terminal pads 100 of less than all of the channels can also be shorted to have some channels responsive to in-plane string vibrations and other channels responsive to longitudinal string vibrations. In addition, remote electrical control of this shorting function may also be provided.

From FIG. 9, it should be noted that preferably the piezoelectric crystals 58 of the various signal channels are so arranged that in adjacent channels the connecting conductor 70 between the two crystals 58 connects faces 62 of different polarity. That is, if in one channel the conductor 70 connects faces of positive polarity then in an adjacent channel, the conductor 70 connects faces of negative polarity. This produces an out of phase relationship between the signals of adjacent channels and helps in reducing the likelihood of one signal channel picking up cross talk from an adjacent signal channel.

Figure 10:
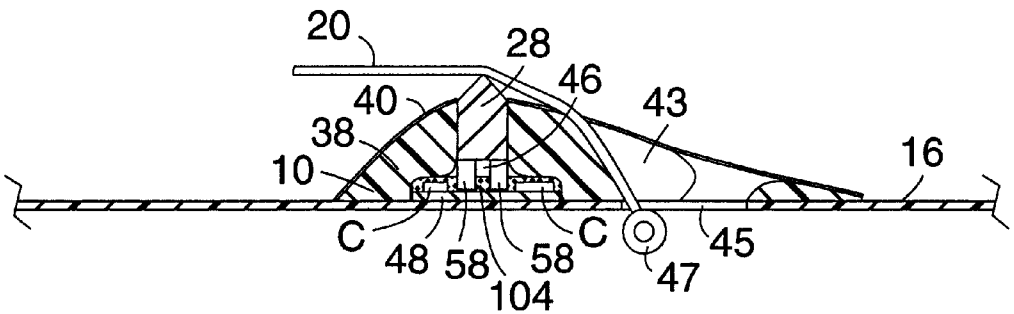
FIG. 10—A sectional view similar to FIG. 4 but showing an alternative embodiment of the invention.

In the bridge 10 as shown in FIG. 4, the portion of the recess 46 which is not filled by the circuit board 48 and its carried components is left empty. As an alternative to this, and if desired, as shown in FIG. 10 some or most all of this empty space of the recess 46 can be filled with a potting material 104 which entirely or partially embeds the components C, but which does not completely embed the peizoelectric crystals 58 so that the upper portions of the crystals 58 remain exposed to receive and engage the lower ends of their associated saddles 28. In this construction, the potting material 104 adheres to both the circuit board 48 and the bridge body 38 so that the circuit board 48 is attached to the bridge body 38 by the potting material.

What is claimed is:

1. A piezoelectric bridge-type pickup for a stringed musical instrument having a top surface and a plurality of generally parallel strings spaced from one another and extending over said top surface, said pickup comprising:

a plurality of sets of two discrete piezoelectric crystals, the number of said sets being equal to the number of said strings and each of the sets being intended to be associated with a respective one of the strings, each set being adapted to be located between said top surface of the instrument and the associated string with the two discrete piezoelectric crystals of the set at different closely spaced positions along the length of the string, and a plurality of discrete saddles equal in number to the number of said strings and each of which saddles is intended to be associated with a respective one of the strings, each saddle being adapted to be located between the string associated with the saddle and the set of two discrete piezoelectric crystals associated with the same string so that said associated string presses down on said saddle and said saddle in turn presses down on both of said two piezoelectric crystals.

2. A piezoelectric bridge-type pickup as defined in claim 1 and further comprising:

a plurality of active electronic circuits equal in number to said plurality of sets of discrete piezoelectric crystals and each located near a respectively associated one of said sets of two piezoelectric crystals, each of said active electronic circuits having a high impedance input terminal supplied with an input voltage signal produced by at least one of said two piezoelectric crystals of the associated set and having a low impedance output terminal at which appears an output voltage signal related to said input voltage signal for transmission from said electronic circuit.

3. A piezoelectric bridge-type pickup as defined in claim 2, wherein:

each of said active electronic circuits also has some gain so that said output voltage signal is an amplified version of said input voltage signal.

4. A piezoelectric bridge-type pickup as defined in claim 3, wherein:

each of said active electronic circuits includes at least one operational amplifier module.

5. A piezoelectric bridge-type pickup as defined in claim 1, wherein:

each of said two piezoelectric crystals of each set has horizontal top and bottom faces between which the crystal is compressed by the associated saddle pressing downwardly on the crystal and also has two spaced vertical faces across which appears a voltage signal having an intensity related to the degree to which the crystal is compressed by the saddle.

6. A piezoelectric bridge-type pickup as defined in claim 2 and further comprising:

a circuit board carrying all of said piezoelectric crystals and all of said active electronic circuits.

7. A piezoelectric bridge-type pickup as defined in claim 6 wherein:

said circuit board is made of a flexible material.

8. A piezoelectric bridge-type pickup as defined in claim 1 and further comprising:

a circuit board carrying all of said piezoelectric crystals, and electrical circuit components carried by said circuit board for conditioning voltage signals produced by said piezoelectric crystals.

9. A piezoelectric bridge-type pickup as defined in claim 8 and further comprising:

said piezoelectric crystals and said electrical circuit components being connected to said circuit board by surface mount technology.

10. A piezoelectric bridge-type pickup as defined in claim 8 and further comprising:

said circuit board being made of a flexible material.

11. A piezoelectric bridge-type pickup as defined in claim 7 for use with a stringed musical instrument having a hollow body including a top plate providing said top surface and having an electronic module located within said body for use with said bridge-type pickup, wherein:

said flexible circuit board has one portion adapted to be positioned between said crystals and said top surface and another portion adapted to pass through an opening in said top plate and into said hollow body for connection with said electronic module.

12. A piezoelectric bridge-type pickup as defined in claim 8 and further comprising:

a body of plastic material having a lower surface adapted to lie uniformly on said instrument top surface and having a recess receiving said circuit board and said piezoelectric crystals and said electrical circuit components carried by the circuit board.

13. A piezoelectric bridge-type pickup as defined in claim 12 and further comprising:

said circuit board having a lower surface exposed relative to said plastic body and flush with said lower surface of said plastic body so that said lower surface of said circuit board directly engages said top surface of the instrument when said lower surface of said plastic body is in engagement with said top surface of the instrument.

14. A piezoelectric bridge-type pickup as defined in claim 13, wherein:

at least a portion of said recess is filled with a potting material which embeds at least a portion of said circuit board and portions of said piezoelectric crystals and circuit components carried by the circuit board.

15. A piezoelectric bridge-type pickup as defined in claim 5 and further comprising:

means defining a top surface of said pickup, and means defining a plurality of saddle recesses each receiving a respective one of said saddles, each of said saddle receiving recesses extending downwardly from said top surface of the pickup to the top faces of the two piezoelectric crystals associated with the received saddle so that the received saddle rests directly on said top faces of the two associated crystals.

16. A piezoelectric bridge-type pickup as defined in claim 1, wherein:

each of said two piezoelectric crystals of each set has horizontal top and bottom excitation faces between which the crystal is compressed by the associated saddle pressing downwardly on the crystal and also has two spaced vertical voltage signal terminal faces across which appears a voltage signal having an intensity related to the degree to which the crystal is compressed by the saddle.

the two voltage signal terminal faces of each of said piezoelectric crystals having respectively negative and positive voltage polarities, and the two piezoelectric crystals of each set being electrically connected in series with one another by having two voltage signal terminal faces of the same polarity directly electrically connected with one another.

17. A piezoelectric bridge-type pickup as defined in claim 16, wherein:

said sets of piezoelectric crystals are arranged in spaced relationship to one another generally along a line adapted to be located parallel to said instrument top surface and in a vertical plane perpendicular to said plurality of strings of the instrument, and in adjacent ones of said sets of piezoelectric crystals the two crystals of each set are so connected in series with one another that in one of the adjacent sets the two crystals have their two voltage signal terminal faces of negative polarity connected directly to one another and in the other adjacent set the two crystals have their two voltage signal terminal faces of positive polarity connected directly to one another.

18. A piezoelectric bridge-type pickup as defined in claim 11 and further comprising:

a decorative cap at least partially covering said plastic body.

19. A piezoelectric bridge-type pickup as defined in claim 18, wherein:

said plastic body is one having been cast into said decorative cap.

20. A piezoelectric bridge-type pickup as defined in claim 16, wherein:

a circuit board carries all of said piezoelectric crystals, and associated with each of said sets of crystals is a pair of accessible terminals on said circuit board connected respectively to the two voltage signal terminals faces of one of the crystals of the set and across which pair of accessible terminals an electrical conductor may be optionally connected to short out said one crystal.

21. A piezoelectric bridge-type pickup for a stringed musical instrument having a top surface and a stretched string extending over said top surface, said pickup comprising:

a piezoelectric crystal adapted to be located between said top surface of the instrument and the string, a saddle adapted to be located between said piezoelectric crystal and said string so that said string presses down on said saddle and said saddle in turn presses down on the piezoelectric crystal, a circuit board adapted to be located between said piezoelectric crystal and said top surface of a stringed musical instrument and carrying said piezoelectric crystal, and a first electronic circuit carried by said circuit board and connected with said piezoelectric crystal, said active electronic circuit having a high impedance input terminal for an input electrical signal produced at least in part by said piezoelectric crystal and having a low impedance output terminal at which appears an output electrical signal related to said input electrical signal.

22. A piezoelectric bridge-type pickup as defined in claim 21, wherein:

said active electronic circuit includes at least one operational amplifier module.

23. A piezoelectric bridge-type pickup as defined in claim 21, wherein:

said circuit board is made of a flexible material.

24. A piezoelectric bridge-type pickup as defined in claim 21 for use with a stringed musical instrument having a plurality of strings, wherein:

a piezoelectric crystal such as aforesaid, a saddle such as aforesaid, and an active electronic circuit such as aforesaid is provided for each of said strings, and wherein said circuit board carries all of said piezoelectric crystals and active electronic circuits.

25. A piezoelectric bridge-type pickup as defined in claim 21, wherein:

each of said active electronic circuits has some gain so that its output electrical signal is an amplified version of its input electrical signal.

26. A piezoelectric bridge-type pickup as defined in claim 21, wherein:

each of said active electronic circuits includes at least one operational amplifier module.

27. A piezoelectric bridge-type pickup as defined in claim 21, and further comprising:

a second active electronic circuit carried by said circuit board and connected to said output terminal of said first electronic circuit so as to receive said output signal of said first electronic circuit.

28. A piezoelectric bridge-type pickup for a stringed musical instrument having a top surface and a string extending over said top surface, said pickup comprising:

a circuit board adapted to be located between said top surface and said string, a piezoelectric crystal on said circuit board, and a saddle adapted to be located between said crystal and said string so that said string presses down on said saddle and said saddle in turn presses down on said crystal, said circuit board having two terminal pads for said crystal, said crystal being a transversely polarized one having two signal faces extending vertically of said circuit board and soldered respectively to said two terminal pads of the circuit board.

* * * * *